US007045696B2

(12) United States Patent
Henry

(10) Patent No.: US 7,045,696 B2
(45) Date of Patent: May 16, 2006

(54) SINGLE ADJUSTMENT BALANCING AND TUNING OF ACOUSTIC DRUMS

(76) Inventor: Thomas R. Henry, 9018 Balboa Blvd., Suite 107, Northridge, CA (US) 91325

( * ) Notice: Subject to any disclaimer, the term of this patent is extended or adjusted under 35 U.S.C. 154(b) by 96 days.

(21) Appl. No.: 10/756,482
(22) Filed: Jan. 12, 2004

(65) Prior Publication Data

US 2004/0159209 A1 Aug. 19, 2004

Related U.S. Application Data

(60) Provisional application No. 60/439,920, filed on Jan. 13, 2003.

(51) Int. Cl.
*G10F 3/00* (2006.01)

(52) U.S. Cl. ..... 84/413; 84/411 R
(58) Field of Classification Search ..... 84/419, 84/411 R, 413, 411 A
See application file for complete search history.

(56) References Cited

U.S. PATENT DOCUMENTS 6,242,680 B1 * 6/2001 Benton, Jr. ..... 84/411 R
6,747,199 B1 * 6/2004 Shah ..... 84/411 R

* cited by examiner

*Primary Examiner*—Kimberly Lockett
(74) *Attorney, Agent, or Firm*—Robert J. Schaap

(57) ABSTRACT

Apparatus and method for enabling simultaneous balancing and tuning of an acoustic drum with a single adjustment. A band, such as a cable, extends about adjustment ties which holds the drum skin or head to the housing or hoop of the drum so that, when tightened, the head will be placed under tension. With the present invention, that tension applied to the skin or head is evenly distributed. In this way, one touch tuning is achieved with simultaneous balancing since there will be a constant tension applied to each of the ties holding the drum skin on the body of the drum.

28 Claims, 5 Drawing Sheets

SINGLE ADJUSTMENT BALANCING AND TUNING OF ACOUSTIC DRUMS

RELATED APPLICATIONS

This application is based on and claims priority by filing date of my U.S. provisional patent application Ser. No. 60/439,920, filed on Jan. 13, 2003, and entitled Single Adjustment Balancing and Tuning of Acoustic Drums.

BACKGROUND OF THE INVENTION

1. Field of the Invention

This invention relates in general to certain new and useful improvements in balancing and tuning of percussion instruments and, more particularly, to the balancing or tuning of a percussion instrument in the nature of a drum which effectively constitutes "one-touch" tuning for a drum.

2. Brief Description of Related Art

The present invention relates largely to percussion instruments and, particularly, to percussion instruments in the nature of drums. In a conventional drum, a drum head or so-called "skin" is placed over at least one or both of the open ends of a drum body or so-called "drum shell". In some cases, skins are placed over both open opposite ends of the drum body. Each skin is conventionally secured to the drum through a so-called "flesh hoop". The skin forming the drum head is retained by the flesh hoop which is in an upwardly opening U-shaped channel, by means of an adhesive, such as a polyester resin and, more particularly, an epoxy resin.

The flesh hoop is retained around the periphery of an open end of the drum by means of a so-called "drum hoop". In this way, a sound chamber is formed within the shell of the drum when the skin is extended over the open end of that drum shell such that when the hoop is struck, the reverberations through the shell cause the generation of a drum sound. If a pair of skins are used, each is effectively retained in the same manner.

There have also been drums used by early American tribal Indians in which a pair of drum heads are placed over both opposite ends of the drum. Each skin forming a drum head was retained by tying the two drum heads together over the open opposite ends of the drum body. Usually, a cord was secured to the peripheral edge of each of the skins and placed under tension so that the skins were moderately taut over each of the open ends of the drum.

In the case of the drums which use bolts and lugs mounted on the shell of the drum, tension to the hoop was applied by adjusting each of the bolts individually. In this way, the drummer could tune the drum and obtain the sound which was desired by the drummer. It can be realized that with a greater number of bolts, a more even tuning could be obtained. However, in this case, the drummer was required to adjust each of the bolts.

It can also be appreciated that when a drummer attempts to tighten the tension on one portion of a drum skin, the drummer necessarily affects all other portions of the drum skin. Consequently, even after a drummer adjusted a group of the bolts and, thereafter, adjusted all of the bolts, it may even be necessary to again readjust certain of the bolts because the tightening of each individual bolt affected the entire head. Moreover, adjustment could only be accomplished by listening carefully to the sound generated when the drum head was contacted by a drum stick.

It can also be appreciated that over a period of time, if cords are used with the tensioning elements, the cord or cable which holds the drum head to the lugs on the sidewall of the drum body would tend to stretch. Even when stretching occurred in very small amounts, that necessarily effected the sound obtained by the drum. Notwithstanding the foregoing, with constant contact of a drum stick on the drum head, stretching would result and the actual contact of the drum stick on several occasions would cause an unbalancing of the tension on the drum head.

It is also known that changes in temperature and even humidity, as well as other environmental factors will also cause drum heads to either contract or expand, depending upon the material of construction. The same holds true to the cords which hold the drum head to the sidewall of the drum body.

Due to the difficulties in tuning a drum head arising out of the fact that the drummer must adjust each portion of the drum head where it is attached to the drum, the actual tuning becomes a very time consuming and laborious task. The task becomes more arduous when the drummer must tune by listening to the sounds generated therefrom and if other sounds are generated in the surrounding ambient environment, the drummer cannot properly tune the drum. As a result, most percussionists do not properly tune the drum, if at all, and on those occasions when they do attempt to tune the drum, it frequently is not tuned properly.

There have been a few attempts to provide so-called "one touch" tuning for drums in the past. These attempts rely upon some system to attempt to obtain tonal quality of the drum head which is the same at all points along the drum head. However, in practice one touch tuning ended up as a goal as opposed to any realistic means for providing tuning of a drum with a single touch or a single adjustment.

There is still a need for some means to provide both the balancing of a drum head to ensure constant tensions on all portions of that head and a need for one touch tuning, that is tuning with a single adjustment. Heretofore, all such efforts to achieve this result have been defied.

OBJECTS OF THE INVENTION

It is, therefore, one of the primary objects of the present invention to provide a system for balancing and tuning a drum head and independently thereof, a system and a method for tuning a drum head with effective one touch adjustment and balancing or tuning of a drum head.

It is another object of the present invention to provide a one touch tuning of a drum head in which all portions of the drum head are placed under equal tension and the head is effectively tuned at all points across the surface thereof with a single adjustment.

It is a further object of the present invention to provide a system of the type stated to achieve one touch tuning which can be incorporated in a new drum construction and which can also be added to existing drums as a retrofit item.

It is an additional object of the present invention to provide an apparatus for use with the individual tensioning devices securing a drum head to a drum body and which employs a plurality of force converting elements with a single cable capable of engagement with each force converting element and causing each force converting element to apply a constant tension to the portion of the drum head to which it is attached such that there is a constant tension uniformly around the entire periphery of the drum head.

It is also an object of the present invention to provide an apparatus of the type stated which can be constructed at a relatively low cost and which is, therefore, adaptable for use in a wide variety of drums and which still operates efficiently to achieve a desired tuning or balancing.

It is another salient object of the present invention to provide a method of simultaneously balancing and tuning a drum head effectively with one touch tuning.

With the above and other objects in view, my invention resides in the novel features of form, construction, arrangement and combination of parts and components presently described and pointed out in the claims.

SUMMARY OF THE INVENTION

The present invention relates to a system for balancing all portions of a head or skin on a percussion instrument, both individually through individual adjustment devices and also simultaneously as a group to cause an application of constant pressure to all portions of a drum head. In particular, the system of the present invention relies upon adjusting the amount of pressure at each point along the periphery of a drum head by a force located almost substantially perpendicular to the plane of the drum head itself.

It is important to obtain both a proper balancing of the tension at all points along the periphery of the drum head as well as to obtain proper tuning. In other words, one-touch tuning with an even distribution of tension across the head is not effective unless there is a generally consistent tension at all points of connection of the drum head to the body of the drum or the hoop of the drum. In effect, the present invention provides both that balancing and one-touch tuning by applying tension to a continuous cable with a resultant radial inward force and converting that radial force into an axial force directly applied to the head. Moreover and of significant importance, is the fact that there is an ability to directly control the amount of tension applied to the head.

The aforesaid tightening of the drum head in the manner as described also allows for proper tuning of the drum head with a single adjustment, inasmuch as there is a balancing of the tension across the drum head, the drum is essentially tuned by this single adjustment. In this way, it is no longer necessary for the drummer to manually adjust each of the individual ties.

This present invention thereby provides a unique and novel single adjustment balancing and tuning of acoustic drums, which thereby fulfills all of the above-identified objects and other objects which will become more fully apparent from the consideration of the forms in which it may be embodied. One of these forms is more fully illustrated in the accompanying drawings and described in the following detailed description of the invention. However, it should be understood that the accompanying drawings and this detailed description are set forth only for purposes of illustrating the general principles of the invention.

The invention thus provides an acoustic percussion instrument in the nature of a drum having an elongate drum body of generally cylindrical cross-sectional shape and a head extended over at least one initially open end of said body. This construction provides an interior sound generating chamber. The present invention is also operable with a head extended over each initially open end of the body.

The present invention primarily resides in both an apparatus and a method to convert a radial force applied about the drum body and pushing inwardly in the direction of the sound generating chamber, into an axial force which tends to move the hoop to which the head is attached in an axial direction away from or pulling on the head. In this way, the head is held under greater tension. In accordance with the present invention, a plurality of relatively rigid and movable force converting elements are provided and attachable to the drum body and/or the hoop. In addition, the invention relies upon a cable which is engageable with and applies a compressive force to the force converting elements. Moreover, the invention also relies upon a tensioner or tension controlling member which is associated with the cable, such as a turnbuckle or the like. This force controlling member can be controlled manually by an operator of the apparatus to apply a desired amount of tension and, in the process, thereby change the tonal quality generated by the drum head.

The term cable, as used in the present application, is used in a broad sense to include any instrumentality which provides a continuous radially inwardly directed force. Thus, a band could function as this instrumentality and, in this sense, the term cable is used to include a band, a cord, a tie or the like which can provide this radially inwardly directed force. Thus, the term cable can include a somewhat rigid member which is capable of being contracted in some fashion to apply an inwardly directed radial force, such that the latter is convertible to an axial force. In this way, tension can be obtained with this instrumentality so that it is equally applied to all portions of the periphery of the drum head.

One of the important aspects of the present invention is the fact that the cable has a low loss in conversion of a radial to an axial force vector. There is, in a sense, a linear leveraged ratio.

The apparatus of the invention may be used as part of a new drum construction. In this case, it is not necessary to use the conventional tension adjusting members, such as bolts and lugs on the side of the drum body, in order to properly apply tension to the drum head. Rather, the apparatus of the invention will provide that desired amount of tension and, also, provide an even amount of tension at each of the points where the drum head is secured to the body of the drum. Thus, the present invention relies on (1) the rigid force direction converting elements, (2) the cable and (3) the tensioner or tension controlling element associated with that cable.

In a more preferred embodiment of the invention, the drum is typically provided with lugs spaced around the circumferential distance of the sidewall and each lug receives a tensioning bolt which is, in turn, secured to or bears against the hoop which holds the head on the body of the drum. Usually, the head is secured to the flesh hoop by a suitable adhesive or the like. Thus, in accordance with the invention, when a pulling force is applied to the hoop, tension is applied to the skin or head. Tension is normally adjusted individually by adjusting each of the individual bolts at each of the lugs. However, that process is tedious and time consuming and usually not very accurate. The present invention thereby truly fulfills the object of one touch tuning which has long been sought.

In one embodiment of the invention, the individual tensioning means can remain on the body of the drum, that is the lugs with the bolts connected to the hoop. In addition, the collective tensioning means of the invention can also be used. Thus, if the collective tensioning means is used, then it is not necessary and usually undesirable to use the individual tension controlling members, such as the bolts or the like. If the collective tensioning means is not used then the individual tensioning elements can be used to maintain the tensioning on the drum. Thus, the user can convert as desired from using the apparatus of the invention back to the original drum construction or use the collective tensioning means of the invention. However, in cases of the new drum construction, the individual tensioning members may not necessarily be employed.

More particularly, the apparatus of the invention may be described as an apparatus for tuning a drum head on a drum musical instrument and which is held taut on the body of the instrument at a plurality of spaced apart connecting points. Each rigid movable force converting element is typically located in the region of each of these connecting points and is movable in such manner so as to convert a radial force into an axial force with respect to the body of the instrument. This axial force tends to pull on the hoop and thereby add tension to the head. Moreover, since it can be seen that the invention provides a continuous uniform radial force, that radial force is converted into an axial force which is also uniformly distributed about the hoop.

The collective tensioning member which extends about the body and engages the force converting elements is adapted to apply this radial force and allow the force converting elements during movement to convert that radial force into the axial force at the region of each of the connecting points. In this way, the force applied by the tensioning member is uniform at each of the connecting points.

In a more preferred embodiment, the force converting element is a rockable element and the movement created thereby is a rockable movement. Moreover, and in one preferred embodiment, the rockable element is somewhat L-shaped, such as an L-shaped bracket, having a pair of legs located at an angle, which is in the embodimet as shown, is an acute angle. The connecting region between the two legs, namely the bight portion of the bracket, is a section in which a rocking action can occur. The tensioning member, as stated above, is a tensioning cord which is extended about the body of the instrument and engages each of the force converting elements.

In the case of the somewhat L-shaped bracket as a force converting element, one leg is disposed relative to the exterior wall of the drum and the other extends inwardly in a somewhat perpendicular arrangement with respect thereto. However, the angle of the inwardly extending leg is usually an acute angle as, for example, an angle ranging from about 45 degrees to 90 degrees. When the continuous belt or cable is tightened as, for example, by a turnbuckle, it tends to push radially inwardly on the outwardly struck leg. Since the inwardly struck leg is restrained against rotational movement about the bight connecting the two legs of the bracket, the force is necessarily converted into an axial force applied to the hoop engaging the head. In other words, since each inwardly struck leg of each force converting member is connected in some fashion to the hoop, there will be an axial pushing force on the hoop at each point where a force converting member is located. As indicated previously, these force converting members are typically located at the region where the head was initially connected to the body of the drum.

There is also a direct linearity in the conversion of the radial force into an axial force using, e.g., a somewhat L-shaped bracket of the type employed in the present invention. In this case, that linearity is a function of the ratio of the length of each of the legs forming part of the somewhat L-shaped bracket. Thus, and for example, if one leg had a length of one unit and the other had a length of two units, there would be a leveraged ratio of 1:2. If each,leg had the same length, there would be a 1:1 ratio. The amount of inward force applied is directly related to the amount of torque and, hence, the amount of axial force applied on the head.

In contrast to the prior art, there is no prior art device which can convert this radial force to a directly related axial force with a fairly precise degree of control. This is quite important in the present invention in that there is a desire to be able to obtain a repeatability and the prior art devices cannot obtain this repeatability.

The tensioner or manually actuable tension applying member is usually manually adjustable. Although a turnbuckle type arrangement can be used, it should be understood that any means to adjust the amount of tension on the cable may be employed. Also in connection with the present invention, it is important to note that the amount of tension applied to the cable and, hence, the amount of the pulling force on the head can be controlled at the will of the operator. Heretofore, there was no means for precisely controlling the amount of tension which is applied to the drum, let alone the fact that there was no means heretofore available for applying a continuous tension to the drum in order to provide one touch tuning.

In another embodiment of the invention, the force converting member could be in the form of a wedge type construction such that a tensioning force on the cable could move a wedge with respect to another wedge creating a form of a camming action. As this occurs, the radial force applied by the cable is converted directly to an axial force with the wedge like members. A true camming surface could also be used in place of the wedge like members. In this case, a camming face could be provided under a disc and bearing against a second disc. In this way, as the cable is pulled more taut, the cable can push downwardly on one disc relative to the other and through the camming action cause a conversion of that radial pulling force on the cable into an axial force. The tightening of the cable actually creates a radial force and this tightening allows an axial force to be imposed on the hoop of the drum and thereby on the head of the drum. In this respect, it is to be noted that the active tightening of the cable operatively applies a vertical force or axial force to the hoop and hence to the body of the drum.

It should also be understood that the percussion instrument of the present invention is not a variable pitch percussion instrument, in the manner as the so-called "Dondo" percussion instrument. In that case, it is intended for the user to apply tension to the various cables, frequently through arm movement of the user, to thereby vary the pitch on a generally continuous basis. In the case of the present invention, on the other hand, after a drum is typically adjusted, the pitch remains the same and it is not changed during the course of rendering a musical composition with the drum. In this respect, the apparatus of the invention can be used with relatively low quality drums to very high quality drums, such as timpani drums used in orchestras and the like.

The invention also provides a unique tensioning mechanism, or so-called tensioner, and which is often referred to herein as a tension applying member. In this case, a type of threaded tightening action is used. A coarse adjustment can be provided by positioning the tensioning cable in a pair of brackets in the threaded tightening type arrangement. Thereafter, turning of a bolt or like element associated with the brackets will allow a more fine type of adjustment by allowing movement of the brackets relative to one another. Moreover, this device is relatively small and unobtrusive and is located so that it will not interfere with the playing of the drum.

This invention possesses many other advantages and has other purposes which may be made more clearly apparent from a consideration of the forms in which it may be embodied. These forms are shown in the drawings forming a part of and accompanying the present specification. They will now be described in detail for purposes of illustrating the general principles of the invention. However, it is to be understood that the following detailed description and the accompanying drawings are not to be taken in a limiting sense.

BRIEF DESCRIPTION OF THE DRAWINGS

Figure 1:
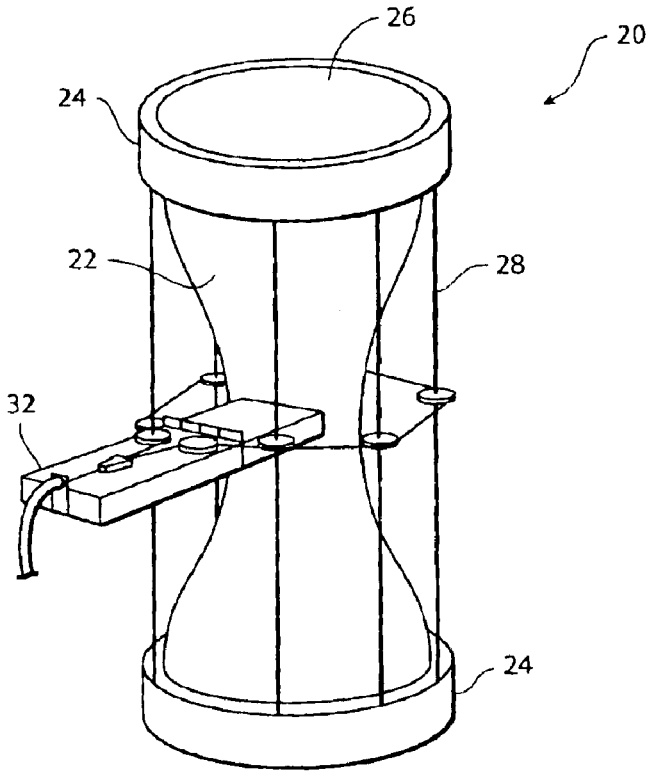
FIG. 1 PRIOR ART
Figure 2:
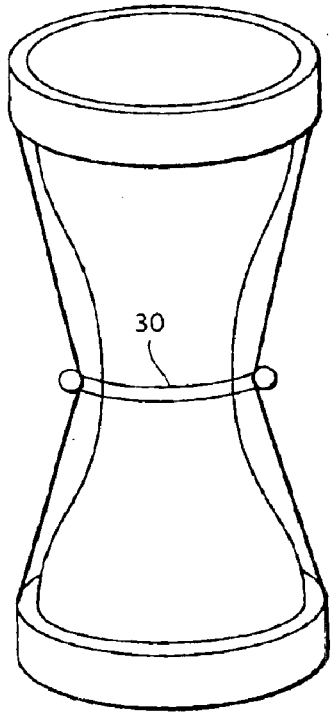
FIG. 2 PRIOR ART
Figure 3:
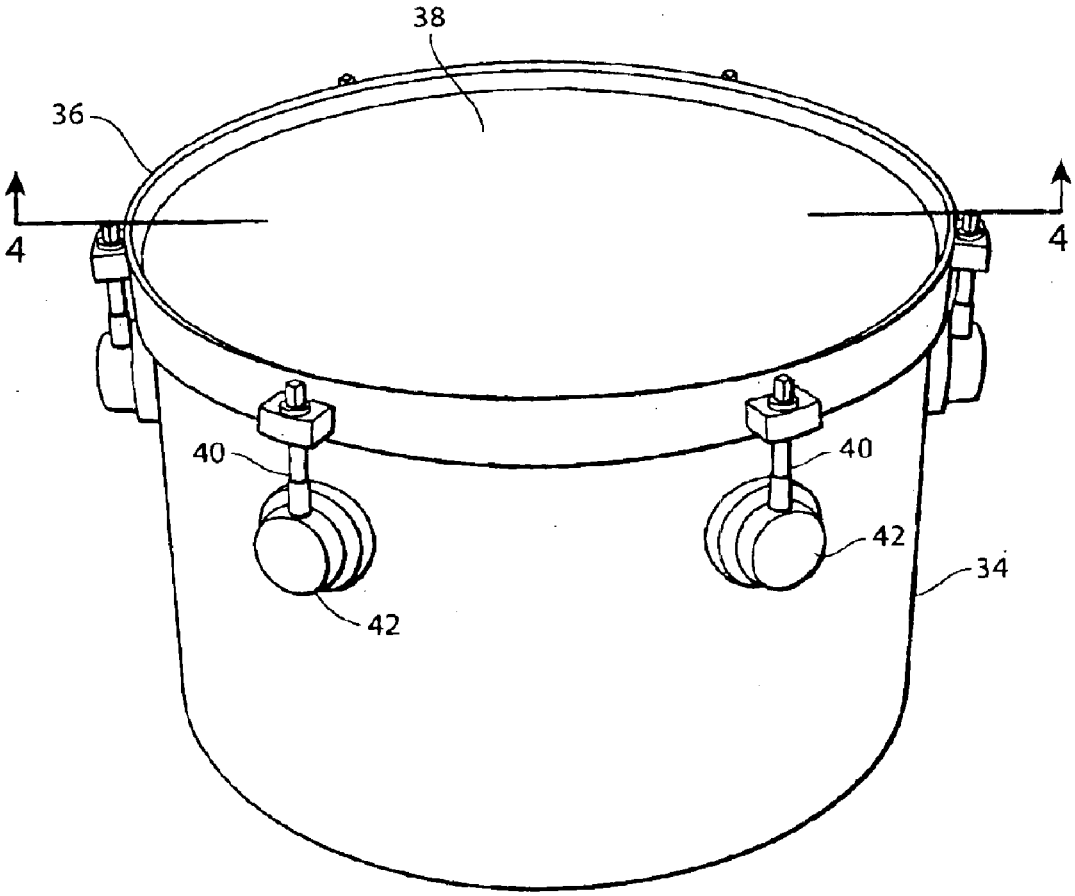
FIG. 3 PRIOR ART
Figure 4:
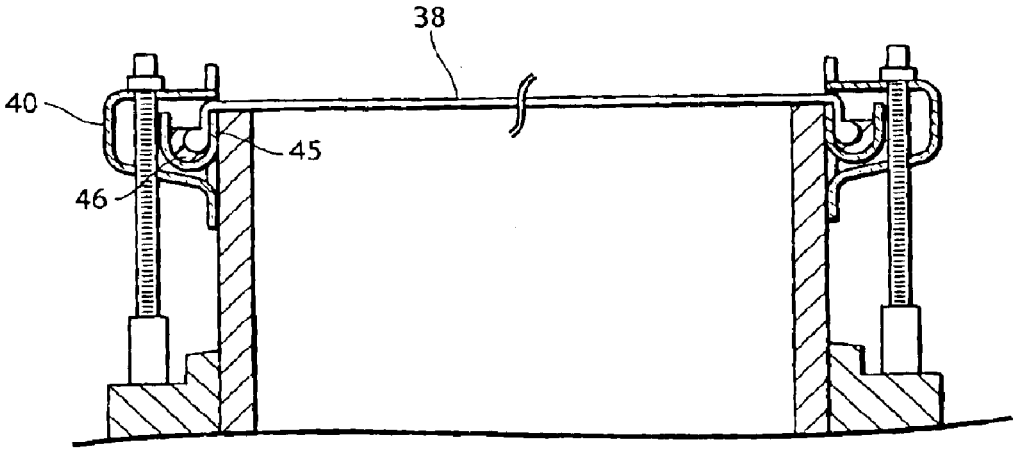
FIG. 4 PRIOR ART
Figure 5:
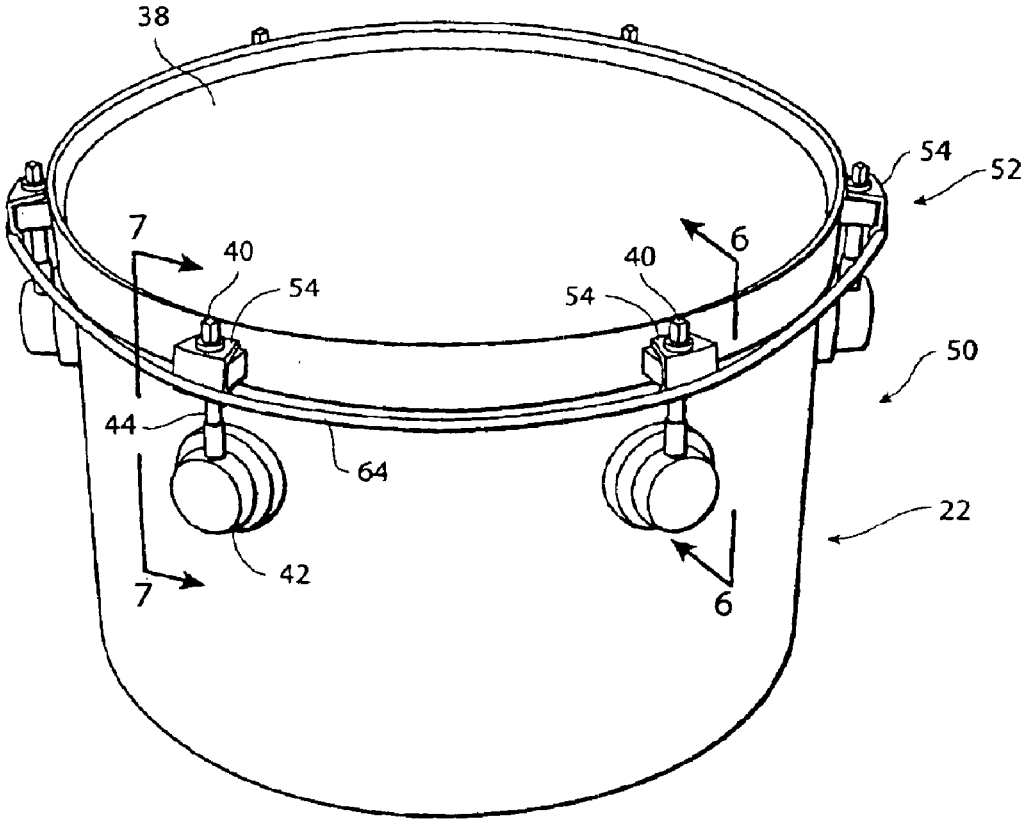
Figure 6:
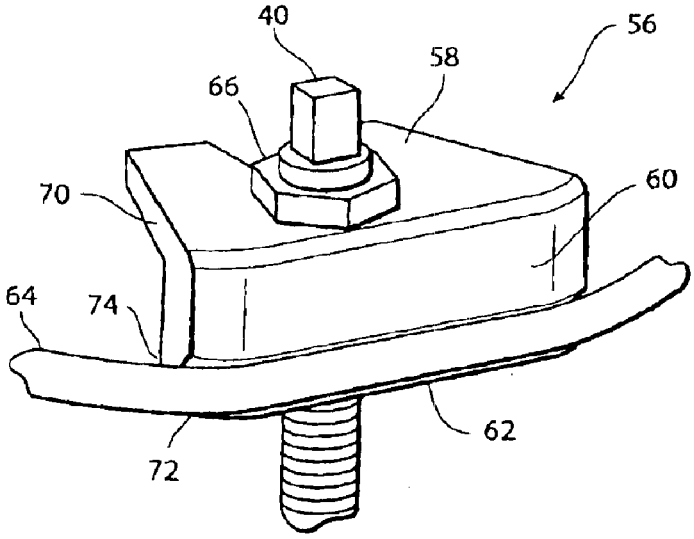
Figure 7:
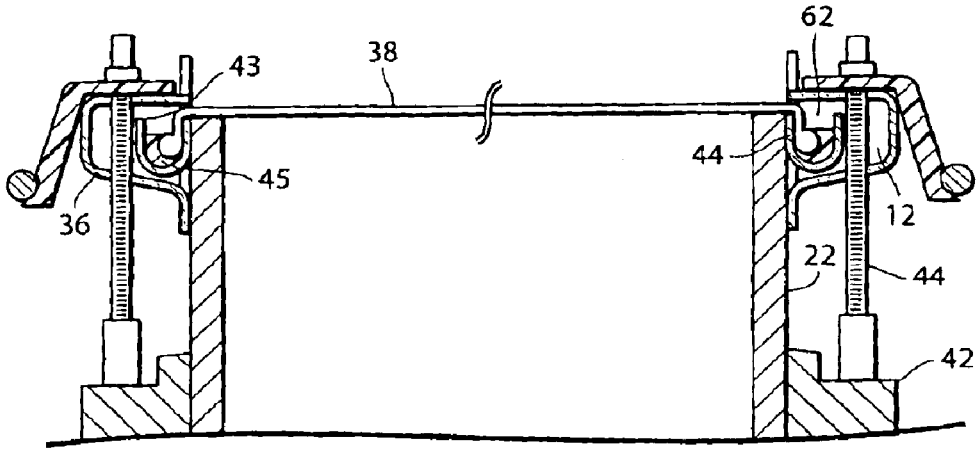
Figure 8:
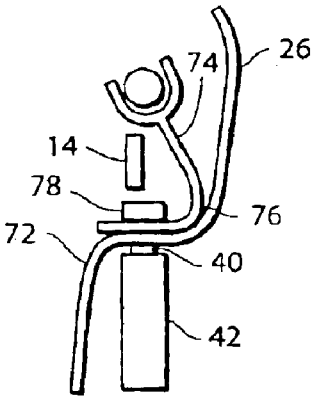
Figure 9:
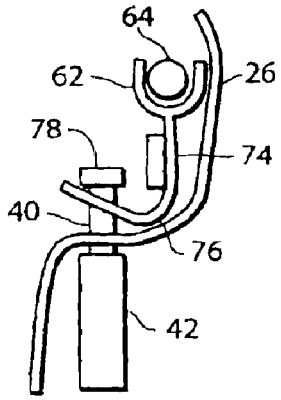
Figure 10:
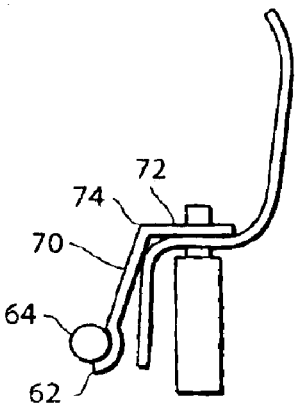
Figure 11:
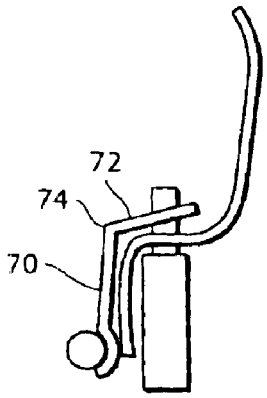
Figure 12:
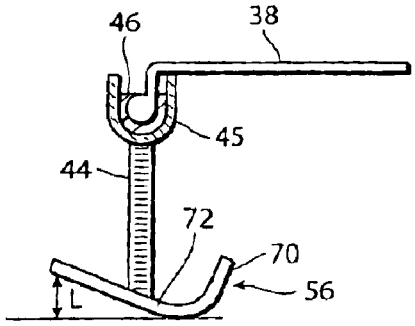
Figure 13:
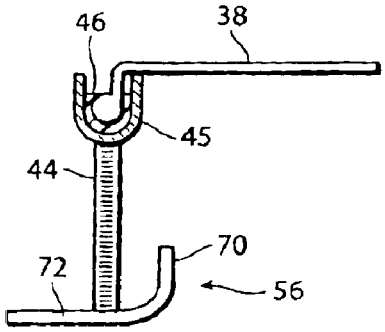
Figure 14:
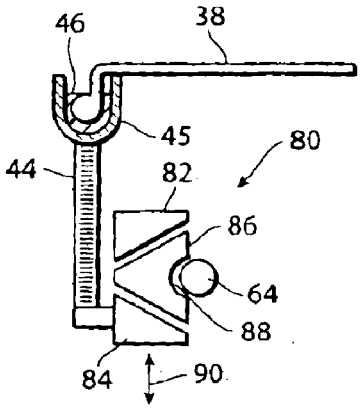
Figure 15:
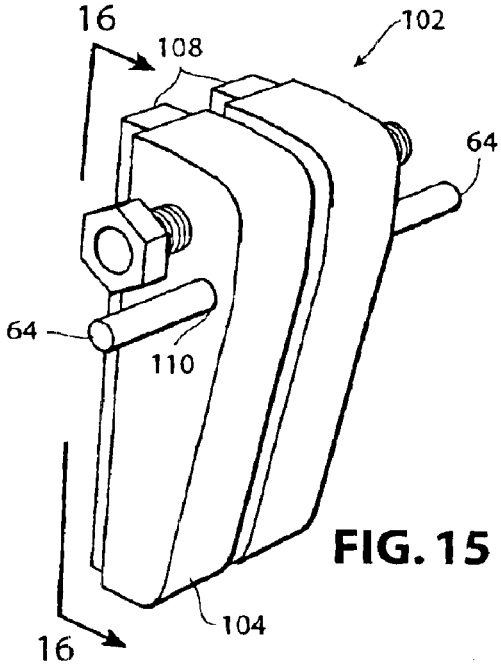
Figure 16:
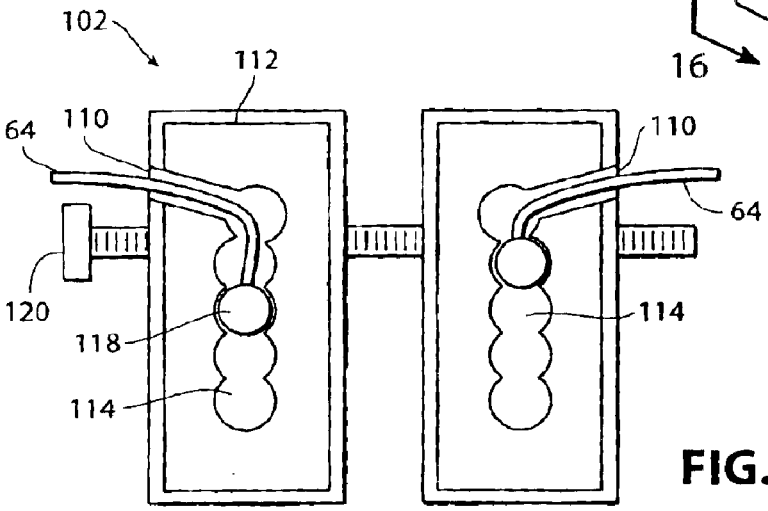

Having thus described the invention in general terms, reference will now be made to the accompanying drawings in which:

FIG. 1 is a perspective view of a variable pitch drum construction representing prior art relative to the present invention;

FIG. 2 is a perspective view of that prior art drum of FIG. 1 and showing the application of a tensioning and hence a radial inward force to cords on the drum;

FIG. 3 is a perspective view of a conventional non-variable pitch drum representative of the state of the prior art;

FIG. 4 is a cross-sectional view, taken substantially along line 4—4 of FIG. 3, and showing the construction of a drum construction used in the mounting of a drum head onto a drum in accordance with prior art construction techniques;

FIG. 5 is a fragmentary perspective view of a drum having the balanced adjustment system of the present invention thereon;

FIG. 6 is an enlarged fragmentary perspective view, taken substantially along the plane of line 6—6 of FIG. 5, and showing in greater detail a force direction converting element forming part of the system in the present invention;

FIG. 7 is a fragmentary sectional view taken substantially along line 7—7 of FIG. 5 and showing in detail the application of the components forming part of the system of the present invention;

FIG. 8 is a somewhat schematic fragmentary side elevational view showing the use of a force converting bracket employed in the system of the present invention;

FIG. 9 is a somewhat schematic fragmentary side elevational view showing a repositioning of a force directing bracket of FIG. 8 in another position to apply a downward force on the drum head;

FIG. 10 is a fragmentary side elevational view showing a modified use of the bracket of FIGS. 8 and 9;

FIG. 11 is a fragmentary side elevational view, similar to FIG. 10 and showing the position of the bracket with the application of a force on the hoop of the drum head;

FIG. 12 is a schematic side elevational view showing the position of a drum head with respect to a force converting bracket of the invention when little or no force is applied thereto;

FIG. 13 is a schematic side elevational view similar to FIG. 12 and showing the position of the head and the bracket when an axial force is applied to the drum hoop and the head thereon;

FIG. 14 is a schematic side elevational view of a modified form of force directing member in accordance with the present invention;

FIG. 15 is a perspective view of a tensioning mechanism used with a tensioning cable of the present invention; and FIG. 16 is a rear sectional view taken substantially along line 16—16 of FIG. 15 and showing the interior of the tensioning mechanism.

DETAILED DESCRIPTION OF A PREFERRED EMBODIMENT

Referring now in more detail and by reference characters to the drawings, FIGS. 1 and 2 illustrate a prior art drum of the type more specifically taught in U.S. Pat. No. 5,610,350, dated Mar. 11, 1997 to Miller for a Variable Pitch Drum or so-called "Dondo Drum". FIG. 2 is an illustration of that same variable pitch drum of FIG. 1 and showing the application of a radial force to various cords used in the construction of the variable pitch drum and which place tension on the heads of the drum.

Referring now in more detail to FIGS. 1 and 2, it can be seen that the variable pitch drum 20 is comprised of a somewhat ellipsoid shaped body 22 having a pair of conical sections forming the body and each of which is provided with a rim 24 holding a head 26. An opposite head could also be applied to the other of the rims 24 if desired and that is usually the construction in the conventional variable pitch drum. A plurality of cords, such as flexible strings 28 or the like, connect the opposed rims 24. In an alternative construction, one of the ends of each of the cords could be connected to a fixed point relative to the body of the drum and the other connected to the rim 24.

When it is desired to change the pitch on the drum, a cable 30 wrapped circumferentially thereabout, engages each of the individual cords 28 and, in effect, moves same toward the inner sound chamber of the drum body. A foot operated mechanism 32 may be employed for this purpose. Nevertheless, this invention does use an effectively controllable radial force to actually apply a vertical force to the rims of the drum and thereby place tension on the heads 26 of the drum. More specifically, the cords are essentially used with a pair of opposed heads and thereby place the drum head under tension. Moreover, the tension across the head is fairly constant, since a cable is used to apply the radial force and which is converted to an axial force.

The aforesaid Miller U.S. Pat. No. 5,610,350 also addresses the fact that a single head could be used on the drum body. Even in the case where there is only a single drum head, there still is no effective means for controlling the amount of force directly applied to and, hence, the amount of tension applied to the head of the drum. This may not be a critical feature in the case of a variable pitch drum, such as the Dondo drum, but it is a very important consideration in a conventional drum where the pitch of the drum cannot be changed during a particular performance with the drum. Nevertheless, whether a single head or a pair of heads are used, there is no means to effectively control the amount of tension applied either to that single head or to the pair of heads with a Dondo drum. In addition, and where a pair of heads are used, the heads are connected to one another and, thus, it is virtually impossible to tune one head without affecting the other head.

FIG. 3 more fully illustrates a non-variable drum of the type conventionally used in the prior art. In accordance with the drum of FIG. 3, there is provided a cylindrically shaped drum body 34 having a rim or so-called "hoop" 36 and which holds a drum head 38. Generally, the drum heads are placed under tension by means of individual tensioning bolts 40 secured to lugs 42 on the exterior of the drum side wall.

A simplified schematic illustration showing the actual mounting of a drum head to a drum body in accordance with prior art construction is more fully illustrated in FIG. 4 of the drawings. In this case, there is provided a somewhat U-shaped mounting hoop 43 which fits circumferentially around the upper end of the periphery of the body and holds the drum head 36. This hoop 43 is typically referred to as a "flesh hoop" and rigidly holds the drum head 38 by means of a suitable retaining member, such as an epoxy or other polyester resin 45 or other hardener. Thereafter, the so-called drum hoop 36 is applied to and basically covers the construction of the flesh hoop and the mounting of the head 38. However, the individual bolts 40 secured to the lugs on the body of the drum are also used to obtain pitch adjustment at each individual point of attachment.

FIG. 5 more fully illustrates a first embodiment of the invention and shows the apparatus of the invention comprising a cylindrically shaped drum body 50. The drum body 50 of FIG. 5 is typically provided with the conventional lugs 42 and the adjusting bolts 44. However, rather than to use the adjusting bolts in order to individually adjust the tension at each mounting point of the head, the system 52 of the present invention is used.

The system or apparatus of the invention comprises a plurality of force direction converting brackets 54, which are mounted on the drum rim where the head is connected to the lugs 42 through the bolts 44. It can be seen that a plurality of generally equally spaced apart force directing or force converting brackets 54 are employed in this respect. Each force converting bracket 54 and its relationship to the body 50 of the drum is more fully illustrated in FIG. 6 of the drawings.

Each force directing bracket is comprised of a top plate 58 which rests upon the drum hoop 40. Moreover, this top plate 58 has a generally axially arranged plate 60 which, in the illustrated embodiment, is shown as a vertically arranged plate, and terminates at its lower end with a cable retaining groove or loop 62. Moreover, it can be observed that a cable 64 in accordance with the present invention is retained in these cable retaining loops 62 formed at the lower ends of each of the brackets 56.

Although the L-shaped bracket is shown as being mounted directly on a tensioning element and, in effect, on the rim of the drum, it should be understood that each of these brackets could be mounted directly to the body of the drum. In essence, it is necessary for a fixed point relative to the body of the drum to hold the tensioner and, hence, the means for applying a force to the head of the drum. However, the force converting brackets are preferably mounted directly at the point where the individual tensioners were previously employed for ease of construction, ease of conversion on a retrofit arrangement and less interference with the aesthetics of the drum.

In accordance with the above-identified construction, when the cable is tightened, it can be observed that there would be a tendency to squeeze the brackets 56 and move the brackets inwardly toward the interior of the drum body 50. However, the brackets 56 are restrained against any axial movement by means of the bolts 40 and associated nuts 66 mounted on the bolts 40. Thus, the cable 64 cannot cause inward movement of the brackets. Rather, since the cable is connected to the flesh hoop or rim hoop of the drum, it causes a slight axial movement of the flesh hoop and the rim hoop downwardly in the direction of the arrow as shown in FIG. 6 and thereby places the head under tension. In other words, the radial force which is applied by tightening of the cable 64 is converted through each bracket 56 into a downward force. The cable 64, which extends about the individual ties is usually located midway between the upper and lower ends of the drum housing. However, it can be located in any desired position. Inasmuch as this cable is adapted to apply tension to the individual ties, it is typically referred to as a tensioning cable.

It can be seen that each bracket 58 is comprised of a top plate 68 which is connected to an axial plate 70 or section plate in the embodiment shown and a plate 72 located at an angle, such as an acute angle, with respect to the axial plate and which, in turn, carries the cable receiving channel 62. In this case, it can also be observed that the bracket actually appears to be somewhat L-shaped. However, the angle of the bracket is typically less than 90 degrees, as aforesaid. In this way, there is a bight portion 74 which connects the two legs 70 and 72. Thus, as a radial force is applied to the bracket, and since the bracket cannot move radially inwardly, it will ride upon the bight portion and thereby cause a lowering or axial movement of the leg 72. This will, in turn, force the axially movable leg 74 downwardly and, hence, cause a pulling on the hoop.

It can be observed that since the cable 64, when tightened, provides a uniform radial force, that radial force is converted into a uniform axial force at any point along the periphery of the hoop. In other words, the force applied to the drum head is uniform throughout all points on the drum head. Thus, by pulling on the flesh hoop or the retaining hoop and, hence, pulling on the drum head, there is an adjustment of the drum head with constant tonal quality throughout the drum head at each point where the head is secured to the drum body. In this way, there is a true one-touch tuning.

It can be observed, by reference to FIG. 7, that it is possible to use either the individual adjustments, if desired, and avoid the use of the one-touch tuning system of the invention. However, it is also possible to avoid the individual adjustments and accomplish the tuning through the tuning system of the invention. In this way, the user of the invention has his or her option to use either of the adjustment systems. However, when using the collective adjustment system of the invention, it is preferable to maintain little or no tension on the head through the various bolts. All tension would therefore be provided by the cable. It is important to note that when using the system of the present invention, there is an inherent balancing of the tension on the drum head at all points where the drum head is effectively connected to the rim of the drum, along with the ability to provide a tuning with a single touch.

FIGS. 8 and 9 more fully illustrate a cross-sectional shape of the cable 64 and its relationship to the drum hoop and the force directing bracket 56 used in the present invention. In this case, it can be seen that each bracket is somewhat L-shaped, as aforesaid, and includes the legs 72 and 74 which are connected by the bight portion 76. Moreover, the bracket is retained with respect to the housing and the lug 42 by means of the adjustment bolts 40. It can be seen that each adjustment bolt has a head 78 which engages the leg 72 of the bracket and limits upward movement. In this way, if the bracket is initially in the position, as shown in FIG. 9, and the cable 62 is tightened, it will apply a radial force 64, but since the bracket is constrained against movement through the action of the radial force, that action is translated into an axial force and this effectively pulls the bracket down or, in effect, shifts the bracket axially to the position as shown in FIG. 8. It can be seen that when the bracket is shifted to the position in FIG. 8, it necessarily pulls the cable 64 therewith and this, in turn, applies tension to the head 38.

FIGS. 12 and 13 effectively show force diagrams and the action upon the drum head. Since the bolt 44 restrains movement of the bracket in a direction which would loosen the head, the additional tension applied by the cable forces the bracket down to the position as shown in FIG. 13. Inasmuch as the bolt 44 effectively restrains movement of the bracket upwardly, but does not restrain movement of the bracket downwardly, the entire mounting hoop 43 on the peripheral edge of the drum head 38 is moved downwardly to the position as shown in FIG. 13. Moreover, the bracket 44 assumes the position as shown in FIG. 13.

By further reference to FIG. 7 it can be observed that there is always a directly proportional movement of the legs 70 and 72 with respect to the movement of the flesh hoop 45. Thus, it can be seen that if there is a movement of a distance L, as shown in FIG. 12, when the bracket assumes the position as shown in FIG. 13, then the flesh hoop 45 and the drum head 38 will be pulled down by a proportional distance. By adjusting the length of the legs 70 and 72, the amount of axial movement of the flesh hoop and, hence, the edge of drum head 38 will be changed.

It is also possible to use the force directing brackets in a reverse position in the manner as shown in FIGS. 10 and 11. If the bracket is initially in the position as shown in FIG. 10 and a compressive force is applied to the cable 64, the bracket will shift to the position as shown in FIG. 11. In this case, it can be observed that the bracket will assume the position as shown in FIG. 11 and thereby provide a pulling force on the bolt and, hence, pull the flesh hoop axially. As this occurs, additional tension will be placed on the drum head 38. However, in this case and in the arrangement as shown in FIGS. 10 and 11, the pivot point is shifted to the inside portion of the bight portion 74, as shown.

As indicated previously, it is also possible to use other force converting elements in accordance with the present invention. Thus, FIG. 14 is illustrative of one embodiment of a force converting element 80. In this respect, it should be understood that the term force converting does not convert the force per se but, rather, converts the direction of application of the force. In any event, the force converting element 80 comprises a pair of wedge blocks 82 and 84 along with a shiftable wedge 86. The wedge block 86 is provided with a recess 88 to receive the cable 64. As the cable is tightened, a radial force is applied directly to the wedge block 86 tending to move to the left, reference being made to FIG. 14. In other words, the wedge block provides a true radial force generally perpendicular to the body of the drum. If the wedge blocks 82, 84 and 86 were located on the rim of the drum or on the flesh hoop, they would provide an axial force 90, as shown by the arrow 90 in FIG. 14. In this way, if the bolt 44 is connected to the flesh hoop 45, it will tend to pull the same downwardly or in the axial direction.

It should be recognized that the mechanism of FIG. 14 is only one mechanism which could be used for converting a radial force into an axial force. As indicated previously, a pair of washers having opposed camming faces could also be used. In this way, when each camming face has its high point bearing against the opposite camming face, there will be force tending to separate the two cam faces. Although the cable does not cause a true radial force by mere tightening of the cable, the mere fact that it is tightened does create a radial force and, hence, this is deemed to be the conversion of a radial force into an axial force.

FIGS. 15 and 16 illustrate a tensioning mechanism which can be used with the cable 64. In this case, the tensioning mechanism 102 used has somewhat of a turnbuckle action, as hereinafter described. This tensioning mechanism 102 comprises a pair of housings or blocks 104 and 106, as best shown in FIGS. 15 and 16 of the drawings. Each housing is provided with a bumper pad 108 on the rear face thereof to engage against and preclude any marring of the body of the drum. Moreover, each housing is provided with an aperture 110 to receive the cable 64 in the manner as shown in FIG. 15 and, more specifically, in FIG. 16. Each housing is provided with a locking plate 112 to receive respective opposite ends of the cord 64.

Each locking plate is provided with a series of vertically spaced apart recesses 114 in the manner as best shown in FIG. 16. Each of the opposite ends of the cable 64 are mounted onto retaining balls or other spherical elements 118 as shown. Each retaining ball can be place in and retentively held in a particular recess 114. In this way, there is at least a coarse adjustment of the cable 64. In other words, all slack can be removed from the cable 64.

After the coarse adjustment, the two housings are connected together by means of an adjustment screw 120. Moreover, it can be observed that by turning the adjustment screw, there will be a tendency to force each of the housings 104 toward one another. As this occurs, additional tension is applied to the cable 64. This will, in turn, impart a radial force to the force converting members and, thereby, cause an axial force to be applied to the drum hoop or the flesh hoop and the drum head.

Based on the foregoing, it can be seen that one of the unique aspects of the present invention is the fact that there is initially an inward force applied to the brackets causing each of the brackets to pivot about a point which would tend to lift one portion thereof. However, each bracket is restrained against movement by means of a bolt. As a result, there is a vertically created force acting on the retaining hoop which tends to pull the hoop downwardly and thereby causes further tension on a portion of the head. Inasmuch as the tension is consistent throughout, there is an even distribution of forces throughout the head. Nevertheless, each bracket enables a conversion of an inwardly directed force or horizontal force directly into a vertical force.

Thus, based on the foregoing, one of the principal features of the present invention is the fact that the applicant allows for the application of an inwardly directed force by a tightening of the tensioning cable and that force is effectively diverted to a downward or vertical force. Thus, the important aspect of the invention relies upon the use of a cable which operates in such manner as to apply a linear radial force and which is converted through an angle of about 90 degrees to a linear force in a direction angulated with respect to the linear force. Another important aspect is the fact that the amount of the angle can be predetermined in advance and the amount of the force can also be controlled.

As indicated previously, the present invention allows for the use in new drum construction and in retrofit construction. Many drummers are quite specific and highly concerned over any potential for changing any of the components in the drum. In other words, many drummers will purchase a drum based on the careful consideration of the specifications provided by the manufacturers of those drums. Indeed, those purchasers may be willing to forego the use of a one-touch tensioning system if it were necessary to convert any of the components of that drum. The present invention accommodates this concern upon the part of many percussion instrument players. There is, essentially, no requirement to substitute one component for another. There is only a mere addition of brackets and a continuous cable which contains a tensioner. Moreover, the system actually blends with the components of the drum and there is no significant alteration to the aesthetic appearance of the drum. In this way, there is no degradation in the integrity of the original drum when allowing conversion to a one-touch system with the invention.

Thus, there has been illustrated and described a unique and novel single adjustment balancing and tuning of acoustic drums and which thereby fulfills all of the objects and advantages which have been sought. It should be understood that many changes, modifications, variations and other uses and applications which will become apparent to those skilled in the art after considering the specification and the accompanying drawings. Therefore, any and all such changes, modifications, variations and other uses and applications which do not depart from the spirit and scope of the invention are deemed to be covered by the invention.

Having thus described the invention, what I desire to claim and secure by Letters Patent is:

1. An acoustic percussion instrument with capability of providing head tension adjustment both collectively and individually at individual points around a periphery of the head, said instrument comprising:

a) an instrument body having an initially opened end;

b) a head extended across said initially opened end and forming with the body a sound generating chamber;

c) a plurality of attachment points where said head is operatively secured to said body;

d) an individual tensioning element associated with each of said attachment points and each being individually adjustable to adjust the amount of tension applied to the head at each such attachment point; and e) collective tensioning means usable in place of said individual tensioning elements, said collective tensioning means converting each individual tensioning element to a corresponding anchor point and being adapted to apply a uniform tension to said head at each point of attachment and thereby provide a uniform balance across said head.

2. The acoustic percussion instrument of claim 1 further characterized in that each individual attachment element comprises:

a) an individual tensioning element at said attachment means; and b) mechanical adjustment means associated with each such tensioning element to place the head under tension.

3. The acoustic percussion instrument of claim 2 further characterized in that said collective tensioning means comprises:

a) a rigid member movable in response to a force applied about said body; and b) a tensioning cable engageable with said rigid member and providing a downward force which pulls said head downwardly under tension through the action of said cable.

4. The acoustic percussion instrument of claim 3 further characterized in that said collective tensioning means further comprises:

a mechanical adjustment means associated with said tensioning cable to place said tensioning cable under a desired amount of tension and simultaneously cause a downward directed force vector imposed upon said head at each point where a rigid member is mounted.

5. The acoustic percussion instrument of claim 4 further characterized in that each said rigid member is a bracket and said cable is engageable with each said bracket and when tightened, converts a radial inward force into a downward force pulling on said head.

6. The acoustic percussion instrument of claim 3 further characterized in that said rigid member comprises an L-shaped bracket having a first leg and a second leg connected by a bight portion therebetween and which bight portion operates as a pivot to cause movement of one leg and pivoting of said bracket about said pivot point.

7. Apparatus for tuning a drum head on a drum musical instrument in which the head is held taut on a body of the instrument at spaced apart connecting points on the body of the instrument, said apparatus comprising:

a) a rigid movable force converting element located in the region of each such connecting point and being movable in such manner as to convert a radial force into an axial force with respect to the body of the instrument; and b) a collective tensioning member extending about said body and engaging each of said force converting elements and being adapted to apply a radial force with respect to said force converting elements and providing a pulling force on said head in the region of each connecting point regardless of the direction of application of force applied by said tensioning member, such that the force applied by the tensioning member is uniform at each connecting point.

8. The apparatus of claim 7 further characterized in that each rigid force converting element is a rockable element and the movement is a rockable movement.

9. The apparatus of claim 8 further characterized in that the collective tensioning member comprises:

a tensioning cable extended about the body of the instrument and being engageable with each rockable element.

10. The apparatus of claim 8 further characterized in that each rockable element is located to operate on a hoop of the drum instrument and causes a movement of the drum hoop in the axial direction with respect to the body, and where the force applied by each rockable element is the same so that the hoop is pulled in the axial direction with a plurality of uniform forces.

11. The apparatus of claim 10 further characterized in that each rockable element comprises:

a somewhat L-shaped bracket having a pair of legs located at an acute and a connecting region between said legs operates as a section in which a rocking action can occur.

12. The apparatus of claim 7 further characterized in that each rigid force converting element comprises:

a rigid member which is movable to provide a camming action and thereby converts a radial force into an axial force.

13. The apparatus of claim 9 further characterized in that said apparatus comprises:

said tensioning member is a tensioning cord; and a manually actuable tension applying member is associated with said tensioning and to control the amount of tension applied by the tensioning cord.

14. The apparatus of claim 13 further characterized in that said force converting elements and tensioning member and manually actuable tension applying member is used in a new drum construction.

15. The apparatus of claim 13 further characterized in that said manually actuable tension applying member, tensioning member and force converting elements are provided as a kit for use in a retrofit application.

16. For use with a percussion instrument having an elongate body with at least somewhat cylindrical cross section over a portion of its length and a percussion head extended over an end of said body:

a) a plurality of rigid force converting elements which receive a force and cause an axially directed force to be applied to said head;

b) a tensioning cable extendable about and engageable with each force converting element to apply a force thereto and cause a movement of the force converting elements in response thereto to redirect the direction of the force applied to the force converting elements; and c) a tension controlling member associated with the tensioning cable to control the amount of force applied by the cable to the force converting elements.

17. The apparatus of claim 16 further characterized in that each rigid force converting element comprises:

a rockable element and the movement is a rockable movement.

18. The apparatus of claim 17 further characterized in that the tensioning cable is extended about the body of the instrument and being engageable with each force converting element.

19. The apparatus of claim 17 further characterized in that each rockable element is located to operate on a hoop of the drum instrument and causes a movement of a drum hoop in the axial direction with respect to the body, and where the force applied by each rockable element is the same so that the hoop is pulled in the axial direction with a plurality of uniform forces.

20. The apparatus of claim 19 further characterized in that each rockable element comprises:

a somewhat L-shaped bracket having a pair of legs located at an angle and the connecting region operates as a section in which a rocking action can occur.

21. A percussion instrument having the capability of tuning with a single adjustment, said instrument comprising:

a) a body;

b) a head extending over one initially open end of said body;

c) a hoop holding said head on said body under tension;

d) a plurality of separate force converting elements mounted on said drum body and each being movable in response to a force applied thereto and converting the direction of that force; and e) a cable extended about and engaging each force converting element and applying a generally radial force thereto and converting that radial force into an axial force imposed on said hoop and head and which axial force is a uniform pulling force at each point where a force converting element is located.

22. The apparatus of claim 21 further characterized in that each rigid force converting element comprises:

a rockable element and the movement is a rockable movement.

23. The apparatus of claim 22 further characterized in that each rockable element is located to operate on said hoop of the drum instrument and causes a movement of the drum hoop in the axial direction with respect to the body, and where the force applied by each rockable element is the same so that the hoop is pulled in the axial direction with a plurality of uniform forces.

24. The apparatus of claim 23 further characterized in that each rockable element comprises:

a somewhat L-shaped bracket having a pair of legs located at an angle and a connecting region operates as a section in which a rocking action can occur.

25. The apparatus of claim 22 further characterized in that said apparatus comprises:

a manually actuable tension applying member associated with said tensioning member to control the amount of tension applied by the tensioning cord.

26. A method of tuning a drum head mounted on a drum body with a hoop for securing the drum head to the body with a single adjustment tuning thereof, said method comprising:

a) applying a force converting element to said drum body at each point along said drum body where the head is attached to the drum body;

b) applying a tensioning cable about and engaging each of said force converting elements; and c) applying tension to said tensioning cable and causing movement of said force converting elements which converts a radial force applied by said cable to an axial force imposed on said hoop and said head.

27. The method of claim 26 further characterized in that said method comprises:

manually actuating a tension controlling member associated with said cable and causing the cable to apply a compressive force directed radially with respect to the drum body and which force is controllable by an operator thereof.

28. The method of claim 27 further characterized in that said method comprises:

converting the radial force applied by said cable into an axial force by rocking a somewhat L-shaped bracket about a pivot point on that bracket.

* * * * *